US005238085A

United States Patent [19]

Engelmann

[11] Patent Number: 5,238,085

[45] Date of Patent: Aug. 24, 1993

[54] ENGINE OIL MAKEUP AND EXTENDED OPERATION OIL EXCHANGE SYSTEM

[75] Inventor: Randall K. Engelmann, Coon Rapids, Minn.

[73] Assignee: Onan Corporation, Minneapolis, Minn.

[21] Appl. No.: 847,933

[22] Filed: Mar. 6, 1992

[51] Int. Cl.[5] ..... F16N 33/00

[52] U.S. Cl. ..... 184/1.5; 184/6.4; 184/103.1; 123/196 S

[58] Field of Search ..... 184/1.5, 6.4, 103.1, 184/103.2, 105.1; 123/196 S, 196 R

[56] References Cited

U.S. PATENT DOCUMENTS

| | | | |
|---|---|---|---|
| 1,551,204 | 8/1925 | Morgan | 184/103.2 |
| 1,936,778 | 11/1933 | White | 184/103.1 |
| 2,792,912 | 5/1957 | Kangas | 184/103.2 |
| 2,941,622 | 6/1960 | Mosley | 184/103.2 |
| 3,621,670 | 11/1971 | Kinney | 184/103.2 |
| 3,712,420 | 1/1973 | Pelizzoni et al. | 184/105.1 |
| 3,876,037 | 4/1975 | Rath, Jr. | 184/6.4 |
| 3,882,967 | 5/1975 | Gulla et al. | 184/103.1 |
| 3,954,611 | 5/1976 | Reedy | 210/71 |
| 4,012,012 | 3/1977 | Ligler | 244/1 R |
| 4,091,895 | 5/1978 | Lang | 184/103.1 |
| 4,105,092 | 8/1978 | Zeidler et al. | 184/103.1 |
| 4,128,140 | 12/1978 | Riches | 184/1.5 |
| 4,417,561 | 11/1983 | Yasuhara | 184/103.2 |
| 4,421,078 | 12/1983 | Hurner | 123/196 R |
| 4,495,909 | 1/1985 | Hurner | 123/196 R |
| 4,632,080 | 12/1986 | Hurner | 123/196 S |
| 4,674,456 | 6/1987 | Merritt | 123/196 S |
| 4,869,346 | 9/1989 | Nelson | 184/1.5 |
| 5,078,233 | 1/1992 | Oetting | 123/196 R |

OTHER PUBLICATIONS

Brochure entitled "Smart Tank, The Complete Lubrication Automation System"; Power Plus Corp.; California; four pages Jun. 8, 1992.

Manual entitled "Planning and Installation, Circulating Oil Supply Systems for Engines and Transmissions"; Reserve Systems, Inc; Calif.; Sep. 1990; 14 pages.

*Primary Examiner*—Albert J. Makay
*Assistant Examiner*—Alan B. Cariaso
*Attorney, Agent, or Firm*—Merchant Gould Smith Edell Welter & Schmidt

[57] ABSTRACT

An engine oil makeup and extended operation oil exchange system and method are provided for automatically maintaining the amount of engine oil and continuously exchanging engine oil in extended operation between an engine and an oil tank.

18 Claims, 1 Drawing Sheet

ENGINE OIL MAKEUP AND EXTENDED OPERATION OIL EXCHANGE SYSTEM

BACKGROUND OF THE INVENTION

This invention relates to an engine oil makeup and extended operation oil exchange system for automatically maintaining the amount of engine oil in an engine oil sump and for increasing the total volume of oil available for lubricating the engine by continuously exchanging engine oil between an oil tank containing oil and the engine oil sump during extended operation.

Engine oils, used as a lubricants, lose their initial qualities after prolonged or extended use and are no longer effective. Therefore, it is necessary to change the used engine oil after a period of time.

In conventional engine lubrication systems, an internal combustion engine powered by diesel fuel or gasoline is lubricated by lubrication oil which is distributed to moving parts of the engine susceptible to frictional wear. After a prolonged use, however, the quality of engine oil degrades and loses its effectiveness due to accumulation of combustion-generated solid debris and chemicals, accumulation of frictionally generated metallic particles and degradation of molecular weight with attendant drop in viscosity. Thus, such degradation in the quality of the lubrication oil necessitates the changing of the lubrication oil. Further, during engine operation it is necessary to maintain the amount of lubrication oil in the engine. Typically, this is solved by periodically maintaining the oil level and changing the oil as required.

In certain situations, it may be impossible to periodically maintain the oil level and quality. For example, when the engine is located in remote locations or in difficult to reach locations. Also, emergencies may occur wherein it is impossible to periodically maintain the oil level and quality.

One solution to this problem is the use of an engine oil makeup system. In some engine oil makeup systems, engine oil is periodically partially changed to maintain oil level and quality. Another type of engine oil changing system uses an engine oil exchange system, wherein engine oil is circulated to exchange used oil with fresh oil.

U.S. Pat. No. 4,105,092 discloses an engine oil makeup and exchanging system. In this engine oil makeup and exchanging system, excess oil in an engine is transferred to an oil tank at intervals by pumps during engine operation. In addition, U.S. Pat. No. 4,417,561 discloses yet another kind of oil changing system. In this oil changing system, used lubrication oil is recirculated and mixed with fuel in a fuel tank. The oil/fuel mixture is then burned in the fuel system.

The present invention offers improvements over the prior art and solves many problems associated with the prior art.

SUMMARY OF THE INVENTION

One embodiment of the present invention relates to an engine oil makeup and extended operation oil exchange system and method for automatically maintaining the amount of engine oil and for increasing the total volume of oil available for lubricating the engine by continuously exchanging engine oil between an engine oil sump and an oil tank containing oil during extended operation.

Yet, another embodiment of the present invention relates to an engine oil makeup and extended operation oil exchange system and method for automatically maintaining the amount of engine oil and exchanging engine oil between an engine and an oil tank for maintaining oil quality in the engine during extended engine operation. In this embodiment, oil is transferred from a pressurized oil source on the engine to the oil tank.

One advantage of an embodiment of the present invention is that it has two modes of operation. In a first mode, the system functions as an oil makeup system to automatically maintain the amount of engine oil in the engine oil sump. In a second mode, the system functions as both an oil makeup system and an extended operation oil exchange system which effectively increases the total volume of oil available for lubrication of the engine. In the first mode, an oil exchange shutoff valve is closed to prevent engine oil from leaving the engine, and an oil tank valve is opened to supply fresh oil by gravity flow from the oil tank through an oil tank valve to the engine oil sump. A regulator is used to regulate the amount of engine oil added to the engine oil sump so as to maintain the proper level of volume of oil in the engine oil sump. The regulator regulates the level of engine oil in the engine oil sump by closing and opening an oil supply passageway from the oil tank to engine oil sump in response to the changing level of the engine oil in the engine oil sump. Thus, the amount of engine oil in the engine oil sump is automatically maintained during the first mode. In the second mode, the oil exchange shutoff valve is opened to allow engine oil to flow from the engine to the oil tank. In a preferred embodiment, an additional oil filter is used to filter used engine oil flowing from the engine to the oil tank. A restriction orifice, not typically an integral part of the engine, can be used to restrict the flow of filtered oil from the oil filter to the oil tank so as to allow the desired amount of filtered engine oil to flow to the oil tank. During the second mode of operation, engine oil from the engine oil sump is pressurized in the engine and flows to the oil filter through the oil exchange shutoff valve. The filtered engine oil then flows to the oil tank. The restriction orifice between the pressurized engine oil source and the oil tank is predeterminately sized so as to maintain the proper level of oil flow to the oil tank. Thus, oil is recirculated between the engine and the oil tank while maintaining the proper oil level in the oil sump.

It is yet another advantage of an embodiment of the present invention is to provide a drain system to separately drain the engine oil sump and the oil tank or drain them together.

Yet another embodiment of the present invention relates to an engine oil makeup and extended operation oil exchange system for use with an engine having an engine oil sump, comprising:

(a) an oil tank interconnected to said oil sump by an oil passageway;

(b) means for controlling the flow of oil through said passageway so as to maintain the level of oil in said engine oil sump; and (c) oil transfer means, including an oil exchange shutoff valve, interconnecting a pressurized oil source on said engine to said oil tank for transferring oil from the engine to the oil tank, whereby the oil is recirculated between the oil tank and the engine.

Still another embodiment of the present invention relates to an engine oil makeup and extended operation oil exchange system for use with an engine having an engine oil sump, comprising:

(a) an oil tank interconnected to said engine oil sump by an oil passageway;

(b) means for controlling the flow of oil through said passageway so as to maintain the level of oil in said engine oil sump; and (c) means for continuously circulating oil between said oil tank and said engine upon the occurrence of a predetermined condition.

The present invention provides an extended operation oil exchange system to allow an engine to operate without maintenance for long periods of time. This is particularly advantageous where an engine is located in remote or difficult to reach locations or in the case of emergencies when it is not possible to service the engine.

These and various other advantages and features of novelty which characterize the invention are pointed out with particularity in the claims annexed hereto and forming a part hereof. However, for a better understanding of the invention, its advantages, and objects obtained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing in which like reference numerals and letters indicate corresponding parts throughout the several views.

DESCRIPTION OF THE PREFERRED EMBODIMENT

Figure 1:
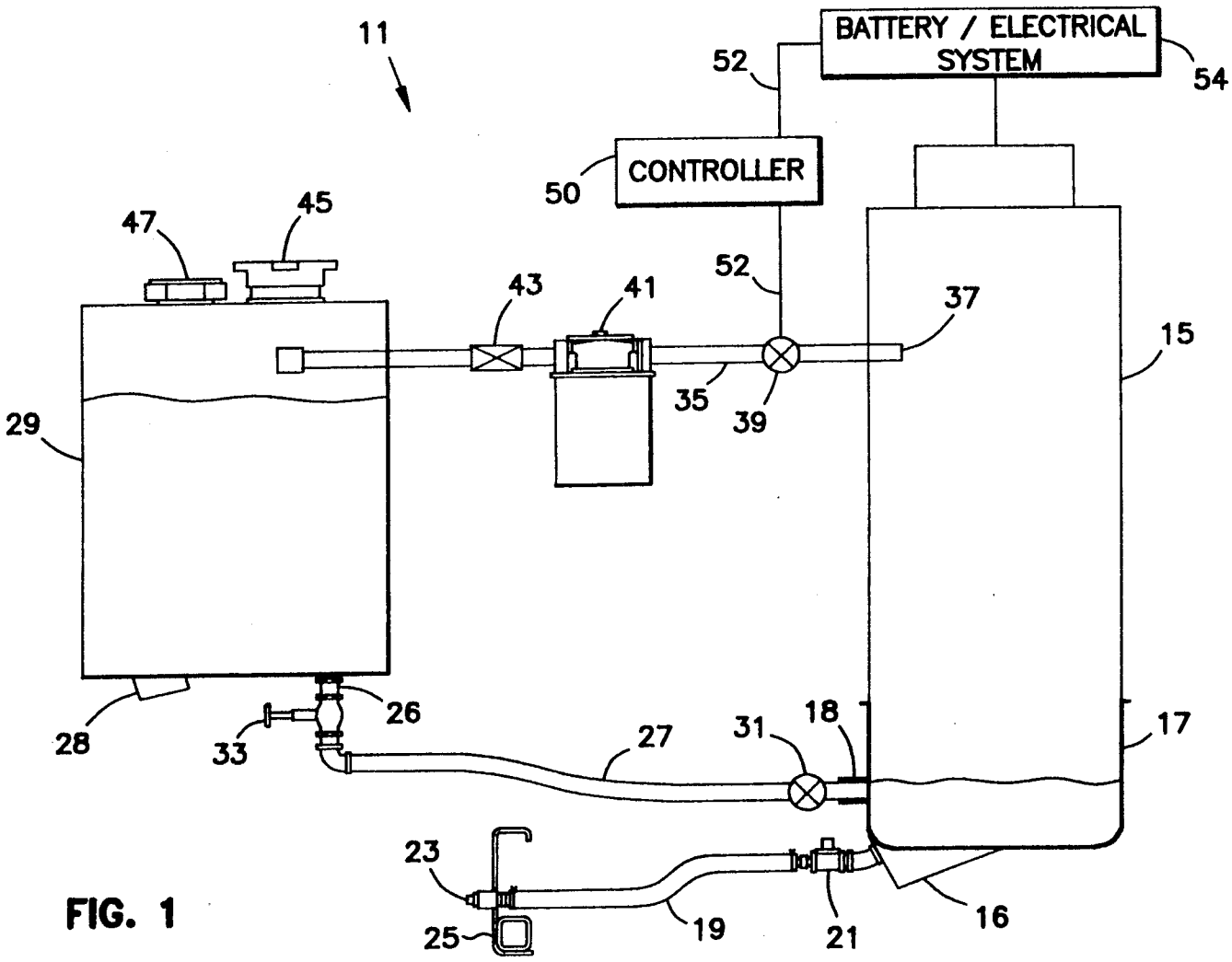
FIG. 1 is a diagrammatic illustration of an embodiment of an engine oil makeup and extended operation oil exchange system according to the present invention.

Referring to FIG. 1, an embodiment of an engine oil makeup and extended operation oil exchange system of the present invention, generally referred to be reference numeral 11, is shown in association with an engine 15 which is lubricated by engine oil in an engine oil sump 17. An oil conduit 27 interconnects an outlet 26 of an oil tank 29 containing engine oil; e.g., four gallons in one embodiment, to an inlet 18 of the oil sump 17 so as to provide an oil passageway therebetween. The oil conduit 27 includes proximate one end a regulator 31. The oil conduit 27 further includes proximate an opposite end an oil tank valve 33 proximate the outlet 26 of the oil tank 29. Fresh oil flows from the oil tank 29 through the oil tank valve 33 to the regulator 31 when the oil tank valve 33 is opened. When the oil tank valve 33 is closed, oil flow from the oil tank 29 to the regulator 31 is prohibited. As shown, the oil tank 29 is positioned at an elevation greater than the oil sump 17 so that oil flows from the oil tank 29 to the oil sump 17 due to gravity. Thus, the oil tank valve 33 can be a simple ball type valve which simply opens and closes the oil passageway.

When the oil tank valve 33 is open, the regulator 31 regulates fresh oil flow from the oil tank 29 to the oil sump 17 in response to the level of the oil in the oil sump 17 so as to maintain the desired oil level in the oil sump 17. In the preferred embodiment, the regulator 31 is a float type valve which opens and closes in response to the changing level of engine oil in the oil sump 17. One example of such a float type valve is the model LR-857 Level Regulator made by Frank W. Murphy Company. Accordingly, the regulator 31 is closed when the oil level in the oil sump 17 reaches the predetermined oil level at which the amount of engine oil in the oil sump 17 is maintained, while the regulator 31 is opened when the oil level in the oil sump 17 drops below the predetermined oil level. The regulator 31 remains opened until the oil level in the oil sump 17 raises to the desired predetermined oil level. It will be appreciated that the regulator 31 might comprise a conventional float type valve or other well known oil regulation devices.

Further in the preferred embodiment shown in FIG. 1, an oil conduit 35 connects a pressurized oil source 37 on the engine 15 with the oil tank 29 so as to provide an oil passageway therebetween. Accordingly, oil under pressure flows from the pressurized oil source 37 on the engine 15 to the oil tank 29. The pressurized oil source 37 might be at any location along the engine's oil lubrication system, where oil is being circulated under pressure by an oil pump (not shown on the FIG. 1) of the engine 15. During engine operation, oil is typically pumped under pressure throughout an engine 15 by the engine's oil pump. Thus, by simply tapping into any of the locations in the engine where oil is being circulated under pressure will provide a pressurized oil source 37. A suitable connector can be used to provide a fluid tight connection of the oil conduit 35 to the pressurized oil source 37. Disposed along the oil conduit 35 is an oil exchange shutoff valve 39 and a restriction orifice 43. The oil exchange shutoff valve 39 opens and closes the oil passageway. When the oil exchange shutoff valve 39 is opened, the oil under pressure is allowed to transfer from the engine 15 to the oil tank 29. When the oil exchange shutoff valve 39 is closed, oil is not allowed to transfer from the engine 15 to the oil tank 29. The oil exchange shutoff valve 39 is preferrably an electrically activated valve such as a solenoid activated valve. Accordingly, the oil exchange shutoff valve 39 enables and disables the exchange of oil between the engine 15 and the oil tank 29. One example of an oil exchange shutoff valve 39 which might be used is the ASCO® 8223 Series valve. An oil filter 41 is used to filter oil flowing from the engine 15 through the oil exchange shutoff valve 39 so that filtered oil flows to the oil tank 29. The oil filter 41 is in addition to the oil filtration that is normally an integral part of the engine's operation. In an alternative embodiment, the oil filter 41 need not be present. The restriction orifice 43 is used to restrict oil flow from the engine 15 and thereby restrict the rate of oil exchange between the engine 15 and the oil tank 29. This prevents oil from leaving the engine 15 too quickly, thereby ensuring that the rate of oil exchange is sufficiently restrained so as to maintain an adequate supply of oil in the engine 15 for lubrication. While it will be appreciated that the rate of oil flow may vary from engine to engine, a typical rate of oil flow might be 0.8 quarts/hour.

In the preferred embodiment shown, the engine oil sump 17 includes an outlet 16. An oil conduit 19 is attached to the outlet 16 and includes an oil pan drain valve 21 proximate the outlet 16. An oil drain pipe plug 23 is positioned proximate the end of the conduit 19. A support bracket 25 is shown as supporting the end of the conduit 19. Accordingly, oil in the oil sump 17 can be drained through the outlet 16.

In the preferred embodiment shown in FIG. 1, an oil fill cap 45 at the top of the oil tank 29 allows an operator to fill fresh oil in the oil tank 29. The oil fill cap 45 also prevents fresh oil from vaporizing. An oil level gauge 47 besides the oil fill cap 45 at the top of the oil tank 29 measures the amount of oil in the oil tank 29. An oil tank drain 28 is positioned at the bottom of the oil tank 29 for draining oil from the oil tank 29. Accordingly, oil in the oil tank 29 can be drained either through the oil tank drain 28 or through the oil sump 17 and the oil conduit 19.

In the preferred embodiment shown in FIG. 1, a controller 50 is used to monitor the hours of engine operation and, upon detection of a predetermined period of engine operation, open the oil exchange shutoff valve 39. In the embodiment shown, the controller 50 is electrically interconnected by an electrical conductor 52 to an engine's electrical system 54 and the oil exchange shutoff valve 39. In one embodiment, the controller 50 might be interconnected to a part of the engine's electrical system 54 which is only energized when the engine is running. The controller 50, in this case, monitors the amount of time that the electrical system is energized, which will correspond to the amount of time the engine is running. Upon detection of the predetermined amount of time, the controller 50 will signal the oil exchange shutoff valve 39 to open via the electrical conductor 52. It will be appreciated that a conventional controller 50 might be used. The controller 50 will contain suitable logic for activating the oil exchange shutoff valve 39 upon detection of the predetermined amount of time. While the amount of time will vary from engine to engine, a typical time of engine operation might be 300 hours. In alternative embodiments, the controller 50 might monitor the occurrence of some other predetermined condition and upon the occurrence of such condition; e.g., quality of oil in the oil sump 17, level of oil in the oil tank 29, etc., the controller 50 open the oil exchange shutoff valve 39. If the quality of oil in the oil sump 17 is monitored, a suitable sensor might be placed in the oil sump 17 to sense oil quality.

In use, when initially setting up the system, fresh engine oil is placed in the oil tank 29. The oil tank valve 33 is then opened. Fresh oil will flow under the influence of gravity to the regulator 31. The controller 50 will have initially closed the oil exchange shutoff valve 39 to prevent oil in the oil sump 17 from leaving the engine 15. Thus, the engine will initially run in the oil makeup mode. The regulator 31 regulates the amount of oil allowed to flow into the oil sump 17 until oil level in the oil sump 17 reaches the predetermined oil level and then maintains the oil at that level. Upon the occurrence of a predetermined condition, for example, a predetermined period of time of engine operation, the controller 50 opens the oil exchange shutoff valve 39 to allow oil under pressure to continuously flow from the engine 15 to the oil tank 29. Meanwhile, oil in the oil tank 29 is fed by gravity to the oil sump 17 through the regulator 31 which maintains the oil level in the oil sump 17. Thus, oil in the oil tank 29 and oil in the oil sump 17 are exchanged. The engine 15 is now in the extended operation oil exchange mode. The system will remain in the extended operation oil exchange mode until stopped by a user for an oil change. In the extended operation oil exchange mode, the volume of oil available for engine lubrication is increased.

While particular example of the usage of the present invention have been shown and described, it is apparent that changes and modifications may be made therein without departing from the gist of the present invention in its broadest aspects. The aim of the appended claims, therefore, is to cover all such changes and modifications as fall within the true spirit and scope of the invention.

What is claimed is:

1. A method of automatically maintaining the quality of oil in an engine lubrication system of an engine, comprising the steps of:

(a) maintaining the level of oil in an engine oil sump of the engine by automatically regulating flow of oil along a first oil passageway from an oil tank containing oil to the engine oil sump; and (b) after the occurrence of a predetermined condition other than a pressurization of the engine lubrication system, continuously circulating oil between the engine and the oil tank by opening a second oil passageway connecting the engine and the oil tank so that oil can flow from the engine to the oil tank.

2. A method in accordance with claim 1, wherein the step of maintaining the level of oil in an engine oil sump includes the steps of:

(1) supplying oil from the oil tank to the engine oil sump by gravity flow through an oil tank valve; and (2) regulating the oil flow by use of an oil regulator to maintain a proper oil sump level.

3. A method in accordance with claim 2, wherein the step of continuously circulating oil between the engine and the oil tank includes the steps:

(1) transferring used oil under pressure from the engine to the oil tank through an oil exchange shutoff valve; and (2) supplying oil from the oil tank to the engine oil sump by gravity flow through the oil tank valve and the oil regulator.

4. A method in accordance with claim 1, wherein the step of continuously circulating oil occurs after a predetermined period of time of engine operation.

5. A method in accordance with claim 3, wherein the step of transferring oil under pressure from the engine to the oil tank includes transferring the oil through an oil filter so as to filter the oil.

6. An engine oil makeup and extended operation oil exchange system for use with an engine having an oil lubrication system including an oil sump, comprising:

(a) an oil tank interconnected to said oil sump by a first oil passageway;

(b) means for controlling the flow of oil through the first passageway so as to maintain the level of oil in said engine oil sump; and (c) oil transfer means including a second oil passageway and an oil exchange shutoff valve, said oil transfer means interconnecting a pressurized oil source at a location along the engine's oil lubrication system on said engine to said oil tank for transferring oil through the second oil passageway from the engine to the oil tank, whereby the oil is recirculated between the oil tank and the engine.

7. An engine oil makeup and extended operation oil exchange system in accordance with claim 6, wherein the oil transfer means includes an oil filter so as to filter the oil being transferred from the engine to the oil tank.

8. An engine oil makeup and extended operation oil exchange system in accordance with claim 6, further including an oil tank valve means for opening and closing the oil passageway.

9. An engine oil makeup and extended operation oil exchange system in accordance with claim 8, wherein said oil exchange shutoff valve and said oil tank valve means are both opened to provide a continuous oil exchange between said engine and said oil tank.

10. An engine oil makeup and extended operation oil exchange system in accordance with claim 8, wherein said oil exchange shutoff valve and said oil tank valve means are both closed to isolate said oil tank from said engine oil sump thereby allowing the oil in said engine oil sump to be drained through a drain outlet during an oil change operation without necessitating draining oil from the oil tank.

11. An engine oil makeup and extended operation oil exchange system in accordance with claim 6, wherein said means for controlling the flow of oil through the passageway includes a regulator responsive to the level of the oil in the engine oil sump.

12. A method of automatically maintaining the quality of oil in an engine having an oil lubrication system, comprising the steps of:

(a) maintaining the level of oil in an engine oil sump; and (b) circulating oil between said engine and an oil tank by transferring oil from said oil tank to said oil sump of said engine and from a pressurized oil source at a location along the engine's oil lubrication system on said engine to said oil tank through an oil exchange shutoff valve.

13. A method in accordance with claim 12, wherein the step of circulating oil between said engine and said oil tank occurs after the occurrence of a predetermined condition.

14. A method in accordance with claim 12, wherein the step of circulating oil occurs after a predetermined period of time of engine operation.

15. An engine oil makeup and extended operation oil exchange system for use with an engine lubrication system of an engine having an oil sump, comprising:

(a) an oil tank interconnected to said oil sump by an oil passageway;

(b) means for controlling the flow of oil through said passageway so as to maintain the level of oil in sad engine oil sump; and (c) means for continuously circulating oil between said oil tank and said engine upon the occurrence of a predetermined condition other than a pressurization of the engine lubrication system.

16. A method in accordance with claim 1, wherein the predetermined condition is a predetermined period of engine running time.

17. A method in accordance with claim 13, wherein the predetermined condition is a predetermined period of engine running time.

18. An engine oil makeup and extended operation oil exchange system in accordance with claim 15, wherein the predetermined condition is a predetermined period of engine running time.

* * * * *